US005810615A

United States Patent [19]

Ohta

[11] Patent Number: 5,810,615

[45] Date of Patent: Sep. 22, 1998

[54] WATERPROOF CONNECTOR WITH COVERING BODY

[75] Inventor: Yukio Ohta, Haibara-gun, Japan

[73] Assignee: Yazaki Corporation, Tokyo, Japan

[21] Appl. No.: 792,455

[22] Filed: Jan. 31, 1997

[30] Foreign Application Priority Data

Feb. 9, 1996 [JP] Japan ..... 8-023780

[51] Int. Cl.[6] ..... H01R 13/62

[52] U.S. Cl. ..... 439/313

[58] Field of Search ..... 439/310–315, 439/319, 345

[56] References Cited

U.S. PATENT DOCUMENTS

| | | | |
|---|---|---|---|
| 2,690,542 | 9/1954 | Pearce et al. | 439/314 |
| 3,351,886 | 11/1967 | Zimmerman, Jr. | 439/319 |
| 3,701,965 | 10/1972 | DuRocher et al. | 439/314 |
| 3,989,337 | 11/1976 | Stelling | 439/314 |

FOREIGN PATENT DOCUMENTS 57-10462 6/1955 Japan .

*Primary Examiner*—Hien Vu

*Attorney, Agent, or Firm*—Armstrong, Westerman, Hattori, McLeland & Naughton

[57] ABSTRACT

A waterproof connector includes a pair of mating connector housings having connecting terminal fittings therein. A covering body rotatably is attached to a cylindrical peripheral wall of one of the connector housings. The covering body has a stopper hook projecting from its inner wall and is mounted with a resilient member for exerting a reaction force to the other connector housing. A locking hook projects from an outer peripheral wall of the other connector housing and engages with the stopper hook of the covering body. An outer wall of the other housing is inserted into the covering body and the stopper hook engages with the locking hook so that the pair of connector housings completely engage and lock to each other.

4 Claims, 8 Drawing Sheets

WATERPROOF CONNECTOR WITH COVERING BODY

BACKGROUND OF THE INVENTION

1. Field of the Invention

This invention relates mainly to a waterproof connector for connection in wire harnesses used for electrical wiring in an automobile vehicle.

2. Prior Art

One of such waterproof connectors is disclosed, for example, in Japanese Utility Model Laid-open No.57-10462, and the waterproof connector is shown in FIGS. 10 and 11 in this application.

This waterproof connector includes a male connector housing a formed with a reduced diameter, cylindrical, supporting portion c adjacent to a recess end face b at an engaging fore end portion. The reduced diameter portion c is mounted with an O-ring d, which constitutes a watertight structure when an opposing connector housing (not shown) is coupled with the male connector housing.

Such waterproof connectors have a sufficient waterproof performance, because they have been generally used in an engine room or a cabin of an automobile vehicle so that the connectors are not hit by jumping stones during running and are not exposed to a severe spraying water during high seed running in rain or during washing of the vehicle. However, when the waterproof connectors are mounted on a lower outside portion of the vehicle or in its fender because of restricted electric wiring, the connectors may be hit by jumping stones during the vehicle's running so that their connector housings may be damaged. Further, when exposed to severe spraying water during high seed running in rain or during high pressure washing of the vehicle, the connectors may suffer water intrusion causing a trouble in an associated electrical circuit. Thus, there has still been the drawback in the waterproof connectors.

SUMMARY OF THE INVENTION

In view of the above-mentioned drawback, an object of this invention is to provide a waterproof connector with a covering body, which has an excellent waterproof performance and a sufficient durability for a shock caused by jumping stones or the like. Moreover, the waterproof connector has a pair of easily, smoothly mating connector housings that are surely prevented from their incomplete engagement.

For achieving the object, according to this invention, a waterproof connector includes:

- a pair of mating connector housings having connecting terminal fittings therein,
- a covering body rotatably attached to a cylindrical peripheral wall of one of the connector housings, the covering body having a stopper hook projecting from its inner wall and a resilient member attached to the body for exerting a reaction force to the other connector housing,
- a locking hook projecting from an outer peripheral wall of the other connector housing and engaging with the stopper hook of the covering body,
- wherein an outer wall of the other housing is inserted into the covering body and the stopper hook engages with the locking hook so that the pair of connector housings are engaged and locked to each other.

Preferably, the covering body is annularly formed with a packing receiving channel and a recess end face in an inner wall of the covering body; the packing receiving channel receives a waterproof packing abutting against an outer peripheral wall of the other connector housing; and the recess end face is mounted with a resilient member.

Preferably, the stopper hook of the covering body is an arrow head shaped hook directed perpendicularly to the connector housing mating direction and has a guide face formed in the fore side of the stopper hook in the connector housing mating direction and a locking end face formed adjacent to the guide face; the locking hook of the other connector housing is also an arrow head shaped hook directed in the opposite direction to the stopper hook and has a guide face formed in the fore side of the locking hook in the connector housing mating direction and a locking end face formed adjacent to the guide face; and by turning the covering body, the guide faces of the stopper hook and the locking hook slidably abut against each other until the locking end faces engages with each other.

Advantageously, the guide face formed in the stopper hook of the covering body has an arc shaped leading end; and the guide face formed in the locking hook of the connector housing also has an arc shaped leading end.

Preferably, the covering body has a recess end face formed with a resilient member receiving recess, the receiving recess mounted with a resilient member of a bent elastic metal sheet.

Operational effects and advantages of the invention will be discussed in the following.

The waterproof connector according to the present invention includes the one of connector housings having the rotatable covering body fitted with the stopper hook. Turning the covering body engages the locking hook fitted to the other connector housing with the stopper hook, which locks mutually the pair of the connector housings in their engagement condition. This accomplishes a smoothly guided, reliable engagement of the pair of connector housings with a smaller engagement force. Covering their engagement portions by the covering body protects them from a direct shock caused by jumping stones or the like during running of the vehicle, which provides an improved reliability in the waterproof connector.

Further, the other connector housing has been exerted by a reaction force from the resilient member mounted in the covering body as long as the connector housings have completely engaged with each other. This eliminates an undesirable gap between the pair of connector housings and a troublesome vibration generated by the gap. This also improves the connector in electrical reliability and waterproofness. Moreover, mounting the packing in the covering body provides improved watertightness between the pair of connector housings. Thus, the waterproof connector according to the present invention has several advantages over the conventional connector.

DESCRIPTION OF THE PREFERRED EMBODIMENT

A preferred embodiment will be discussed in the following.

Figure 1:
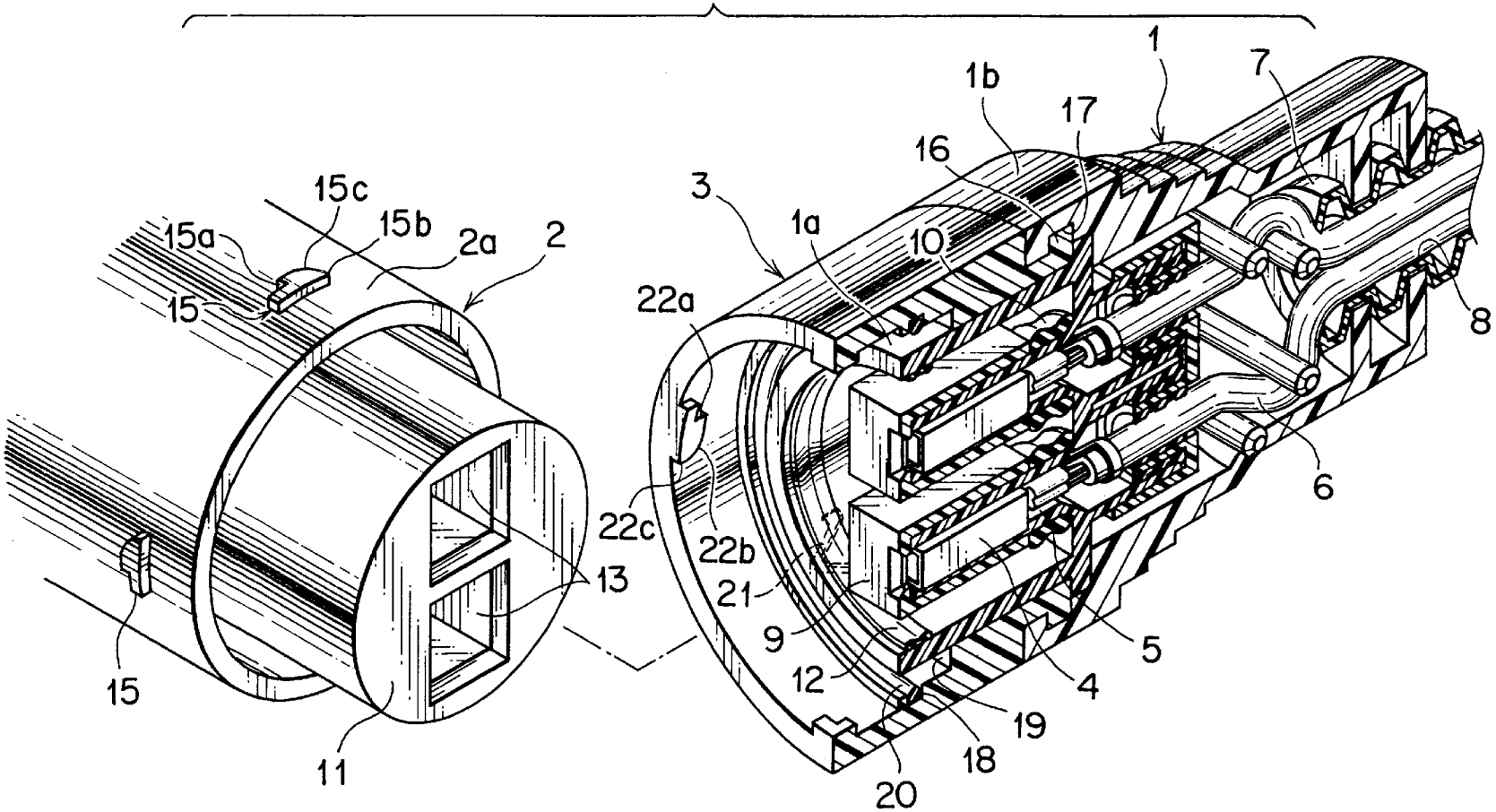
FIG. 1 is a perspective view of a waterproof connector of an embodiment according to the present invention, which is partially cut away to show an inside view.
Figure 2:
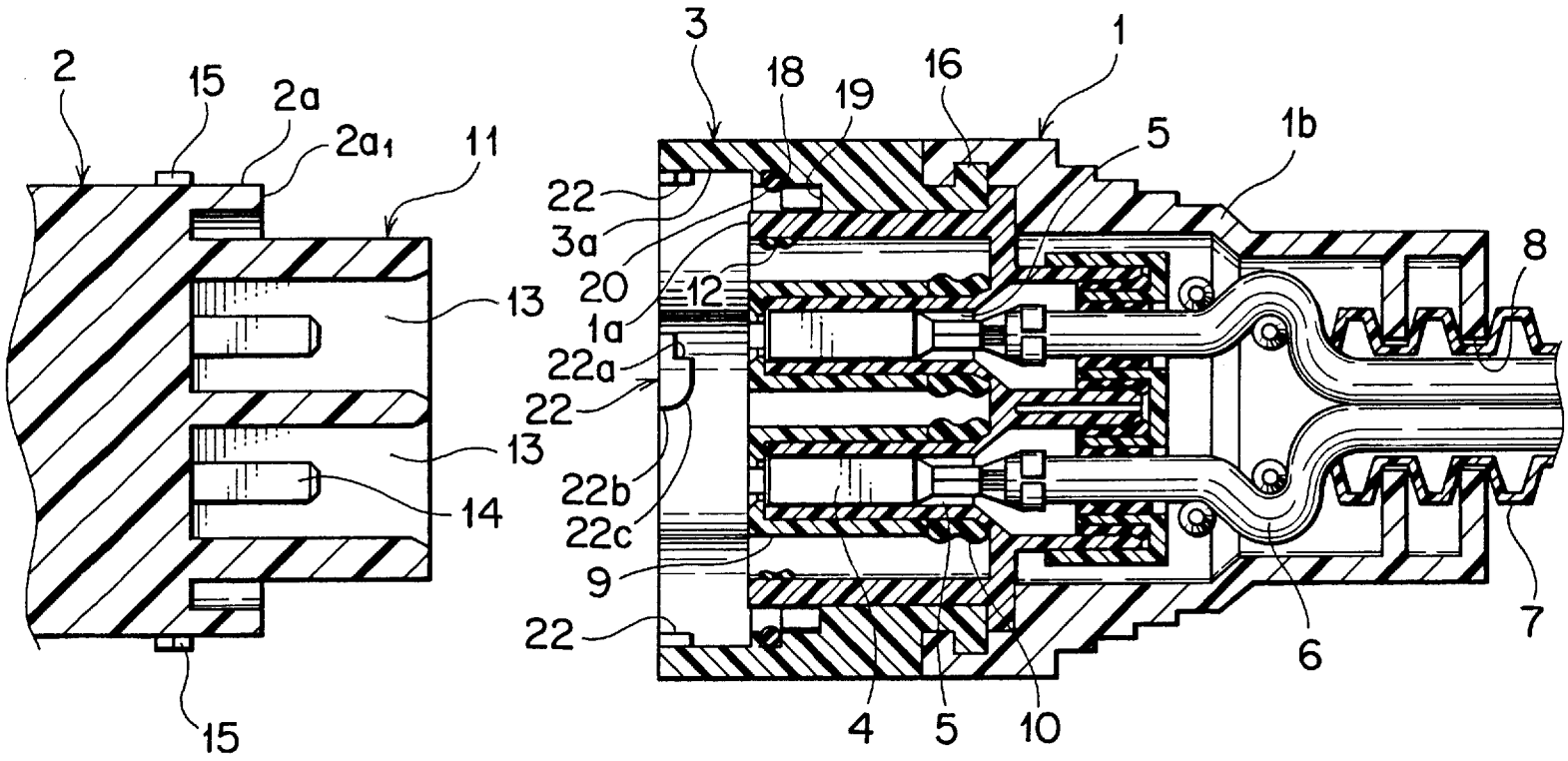
FIG. 2 is a longitudinal sectional view of the waterproof connector shown in FIG. 1.

FIG. 1 is a partially cut-away diagonal perspective view of a hood-equipped waterproof connector A according to an embodiment of the invention. FIG. 2 is a longitudinal sectional view of the waterproof connector A. The waterproof connector A comprises a pair of mating connector housings 1, 2.

The connector housing 1 is made of an electrically insulating synthetic resin. The housing 1 has a covering body 3 rotatably attached to an outer surface of a cylindrical peripheral wall 1*a* of the housing 1. Inside of the cylindrical peripheral wall 1*a* there are provided a plurality of terminal receiving chambers 5 receiving female terminal fittings 4. In the rear side of the cylindrical peripheral wall 1*a* there extends a rear cover body 1*b* delivering a cable 6 connected to the terminal fittings 4 outside of the housing 1 through a bellows-type rubber sealing member 7 provided inside a cable leading opening 8.

The terminal receiving chamber 5 is mounted with a box-shaped retainer 9. The retainer 9 presses a sealing packing 10 against a base portion of the terminal receiving chamber 5. On an inner wall cylindrical peripheral wall 1*a* there is annularly mounted a waterproof packing 12 abutting against a projecting coupling portion 11 of the other connector housing 2.

The connector housing 2 is also made of an electrically insulating synthetic resin. The housing 2 has the projecting coupling portion 11 inserted into the outer peripheral wall 2*a* of the connector housing 1. The projecting coupling portion 11 is formed with a plurality of parallel box-shaped terminal receiving chambers 13 for inserting the retainers 9 covering the terminal receiving chambers 5. Each terminal receiving chamber 13 is mounted with a male terminal fitting 14 that engages with the female terminal fitting 4 in the terminal receiving chamber 5.

The male terminal fittings 14 connect to a cable (not shown) leading out from the rear side of the connector housing 2.

On an outer surface of the outer peripheral wall 2*a* there are fitted with a plurality of spaced, arrow head shaped locking hooks 15.

The covering body 3 molded in an annular shape from a rubber or soft synthetic resin is rotatably attached to an outer surface of the cylindrical peripheral wall 1*a* of the connector housing 1. That is, an outer peripheral projection 16 formed in a rear end of the covering body 3 is inserted into a retaining recess 17 annularly formed in a fore inner surface of a rear protecting body 1*b* of the connector housing 1. Thus, the covering body 3 can turn both clockwise and counterclockwise along the outer surface of the cylindrical peripheral wall 1*a*.

In an inner wall 3*a* of the covering body 3 there are annularly formed a packing receiving channel 18 and a recess end face 19. The recess end face 19 has a plurality of resilient member receiving recesses 19*a* mutually spaced by an appropriate distance. The packing receiving channel 18 is mounted with a sealing O-ring 20 abutting against an outer peripheral wall 2*a* of the other connector housing 2. The resilient member receiving recess 19*a* is mounted with a resilient member 21 formed by bending a thin elastic metal substrate, in which a bent portion 21*a* of the resilient member 21 is facing forward, that is, toward the other connector housing 2.

In a fore end portion of the inner wall 3*a* of the covering body 3 there is fitted with an arrow head shaped stopper hook 22.

The stopper hook 22 has a locking end face 22*a* at its rear side in the connector housing mating direction and a leading end 22*b* of the arrow head orienting perpendicularly to the connector mating direction. Further, the stopper hook 22 has an arc shaped, guide face 22*c* extending from the locking end face 22*a* to the leading end 22*b*.

In the outer peripheral wall 2*a* of the other connector housing 2 there is fitted with an arrow head shaped, locking hook 15. The locking hook 15 is the same in shape as the stopper hook 22 of the covering body 3. The locking hook has an arc shaped, guide face 15*c* extending from a locking end face 15*a* to a leading end 15*b*. The leading end 15*b* is orienting in the opposite direction to the stopper hook 22 of the covering body 3. The locking end face 15*a* is formed at the rear side of the locking hook 15 in the connector housing mating direction.

Next, a mating and locking process of the pair of connector housings 1, 2 will be discussed.

Figure 3:
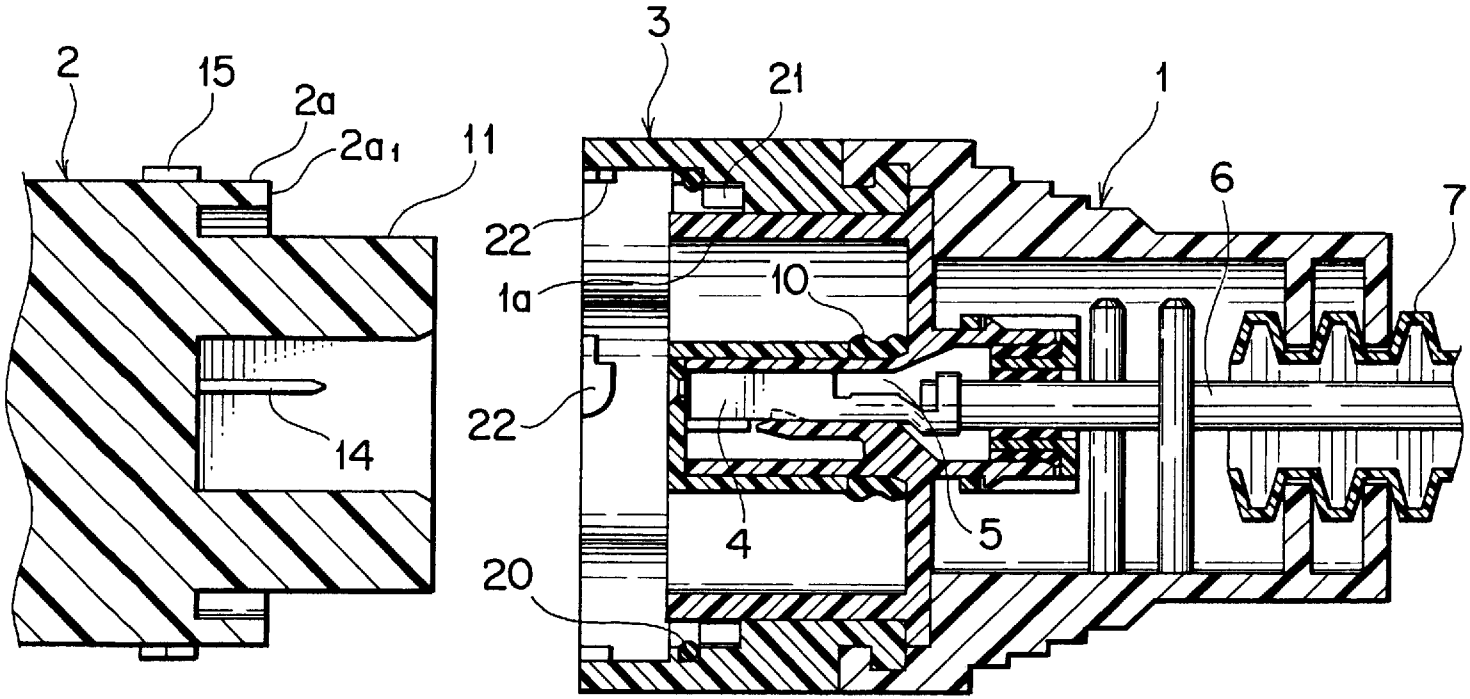
FIG. 3 is a sectional view showing a stage of an engagement process stage of a pair of connector housings in FIG. 1.

In the first stage, as shown in FIG. 3, the connector housings 1, 2 are oppositely disposed. In this stage, each of the stopper hooks 22 of the covering body 3 is positioned between the locking hooks 15 of the other connector housing 2 by adequately turning the covering body 3.

Figure 4:
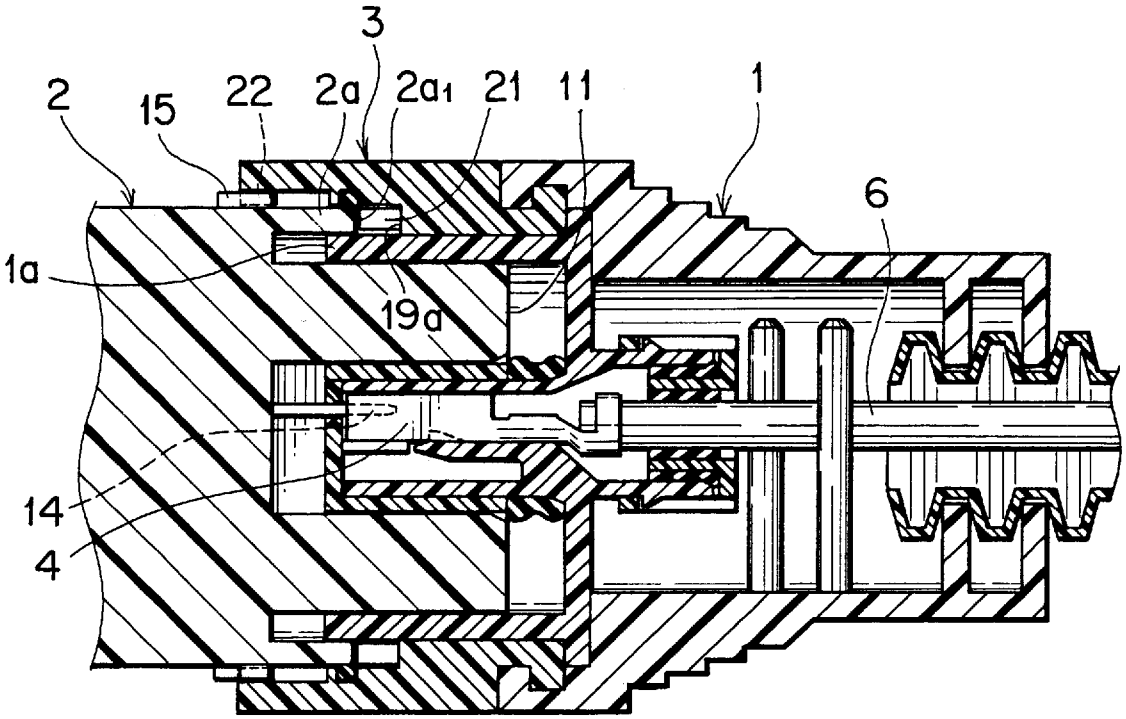
FIG. 4 is a sectional view showing an initial engagement state of the connector housings in FIG. 3.

Then, as shown in FIG. 4, the cylindrical peripheral wall 1*a* of the connector housing 1 receives the projecting coupling portion 11 of the other connector housing 2. Further, each of the female terminal fittings 4 begins to engages with an associated one of the male terminal fittings 14. Moreover, the outer peripheral wall 2*a* of the other connector housing 2 advances into between the cylindrical peripheral wall 1*a* of the connector housing 1 and the inner wall 3*a* of the covering body 3. Then, a leading end $2a_1$ of the outer peripheral wall 2*a* abuts against the resilient member 21 received in the resilient member receiving recess 19*a* of the covering body 3. Thus, the other connector housing 2 receives a reaction force from the resilient member 21.

Figure 5:
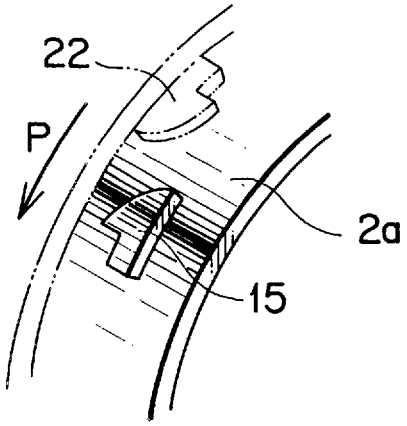
FIG. 5 is an explanatory illustration of mutual movements of a stopper hook and a locking hook respectively fitted to the connector housings in FIG. 1.
Figure 6:
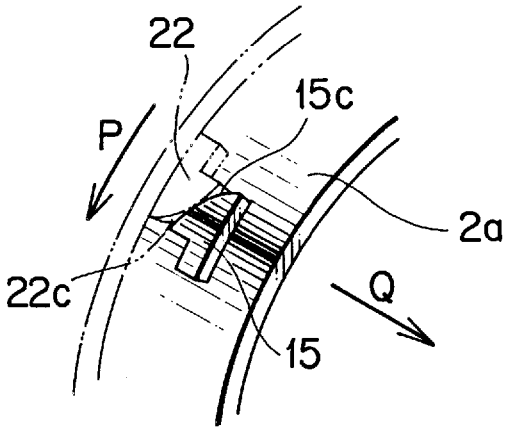
FIG. 6 is an explanatory illustration of a slidable abutment state of the stopper hook and the locking hook, in which the covering body of the one of connector housings in FIG. 1 has been halfway turned.

In this stage, the stopper hook 22 and the locking hook 15 have been positioned in relation to one another as shown in FIG. 5. Next, by turning the covering body 3 in an arrow head direction P, as shown in FIG. 6, the guide face 22*c* of the stopper hook 22 makes slidable contact with the guide face 15*c* of the locking hook 15 so that the locking hook 15 is forced to move in an arrow head direction Q by the stopper hook 22. The arrow head Q directs in the direction to press the resilient member 21 so that the locking hook 15 receives an appropriate resilient reaction force in the opposite direction to the arrow head Q by the resilient member 21.

Figure 7:
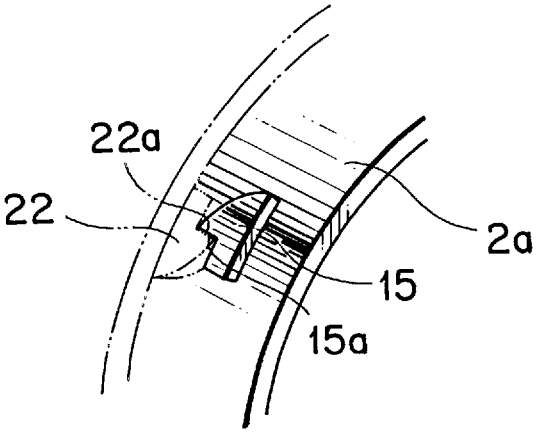
FIG. 7 is an explanatory illustration of an engagement state of the stopper hook and the locking hook in FIG. 6.
Figure 8:
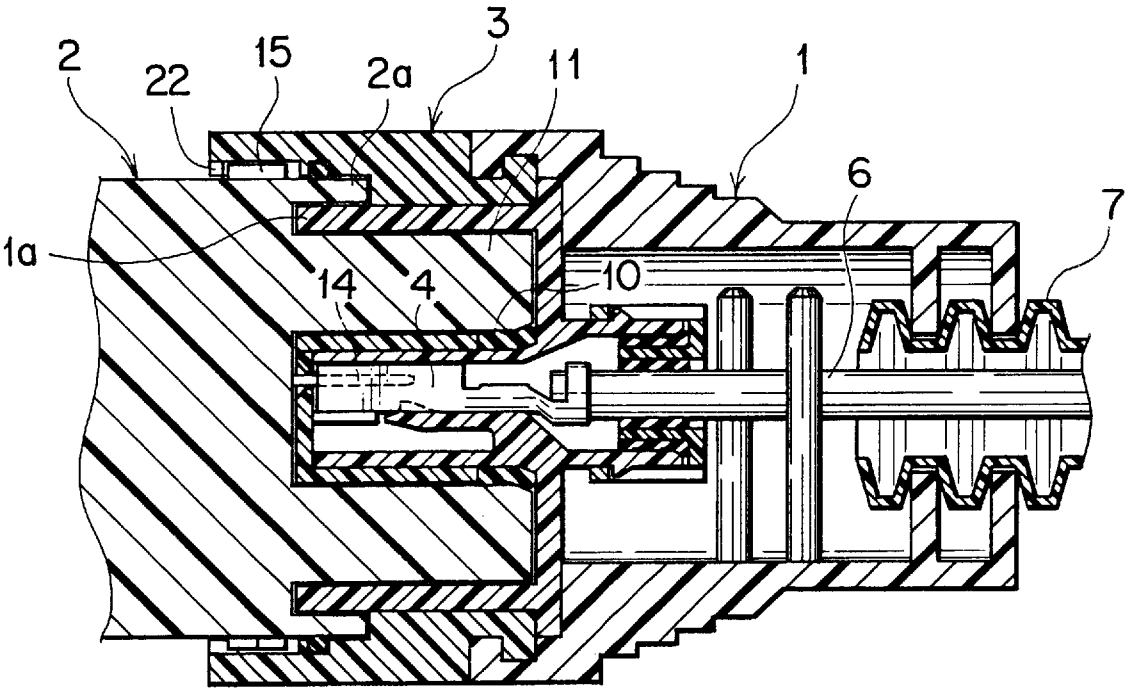
FIG. 8 is a sectional view showing a complete engagement state of the pair of the connector housings in FIG. 3.

Further turning the covering body 3 in the arrow head direction P releases the slidable abutment of the guide faces 22*c* and 15*c*. Thus, as shown in FIG. 7, both the locking end faces 22*a* and 15*a* engage mutually so that, as shown in FIG. 8, the pair of connector housings 1, 2 engage completely with each other in a mutually locked condition.

Figure 9:
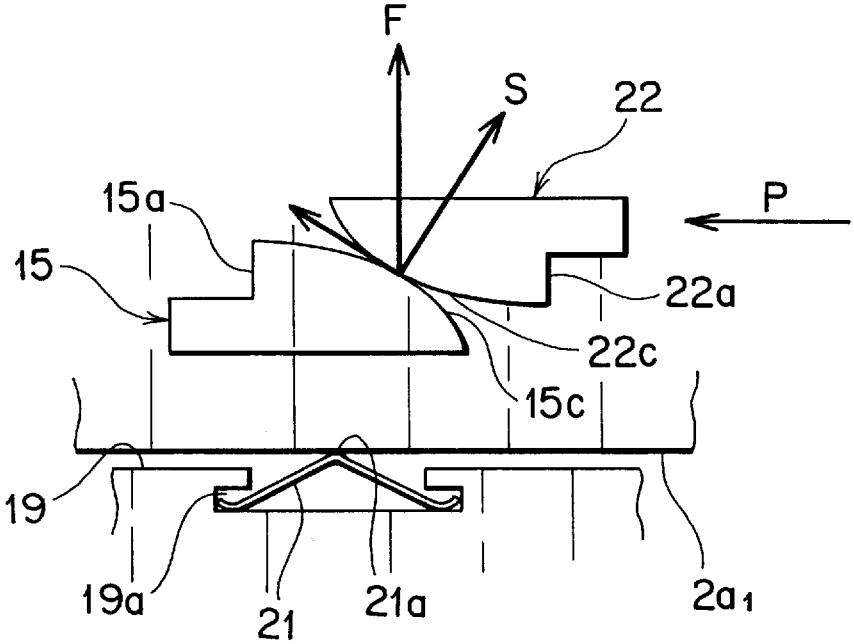
FIG. 9 is an explanatory illustration of a resilient reaction force acted on the stopper hook and the locking hook in FIG. 6 by a resilient member.
Figure 10:
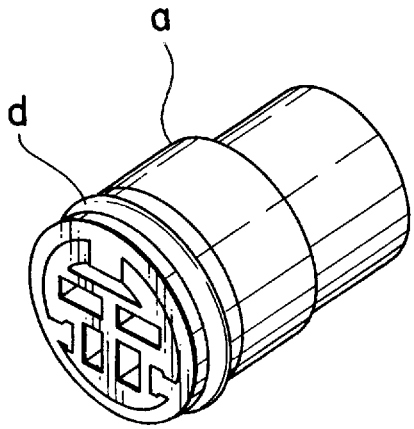
FIG. 10 PRIOR ART
FIG. 10 is a perspective view of a conventional waterproof connector.
Figure 11:
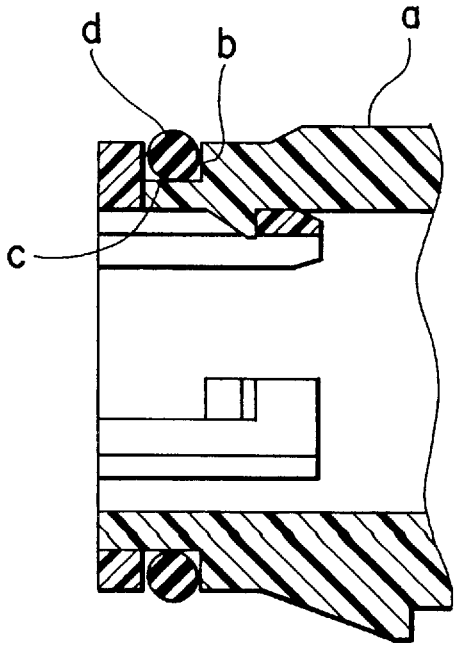
FIG. 11 PRIOR ART
FIG. 11 is a sectional view of the waterproof connector in FIG. 10.

Incomplete turning of the covering body 3 in the arrow head direction P can not engages the locking end faces 22*a* and 15*a* mutually. In this condition, as shown in FIG. 9, the resilient member 21 forces the covering body 3 to turn in the opposite direction to the arrow head P, that is, in the engagement releasing direction. Because the leading end $\mathbf{2}a_1$ of the outer peripheral wall 2*a* receives a reaction force F from the resilient member 21 so that the stopper hook 22 receives a component S of the reaction force F according to an abutting angle of the guide faces 22*c* and 15*c*. Therefore, turning the covering body 3 by a small angle can confirm definitely an incomplete engagement of the pair of connector housings 1, 2.

What is claimed is:

1. A waterproof connector comprising:

a pair of mating connector housings having connecting terminal fittings therein;

a covering body rotatably attached to a cylindrical peripheral wall of a first of said connector housings, said covering body having a stopper hook projecting from an inner wall body of said covering body and a resilient member attached to said covering body for exerting a reaction force to a second of said connector housings;

a locking hook projecting from an outer peripheral wall of said second connector housing and engaging with said stopper hook of said covering body;

wherein said outer wall of said second connector housing is inserted into said covering body and said stopper hook engages with said locking hook so that said pair of connector housings are engaged and locked to each other;

wherein said stopper hook of said covering body is an arrow head shaped hook directed perpendicularly to a connector housing mating direction and has a guide face formed at a fore side of said stopper hook in said connector housing mating direction and a locking end face formed adjacent to said guide face;

said locking hook of said second connector housing is also an arrow head shaped hook directed in a direction opposite to said stopper hook and has a guide face formed at a fore side of said locking end face formed adjacent to said guide face; and by turning said covering body, said guide face of said stopper hook and said locking hook slidably abut against each other until said locking end faces engage with each other.

2. The waterproof connector as claimed in claim 1, wherein said covering body is annular formed with a packing receiving channel and a recess end face in an inner wall of said covering body, said packing receiving channel receives a waterproof packing abutting against said outer peripheral wall of said second connector housing; and said recess end face is mounted with said resilient member.

3. The waterproof connector as claimed in claim 1, wherein said guide face formed in said stopper hook of said covering body has an arc shaped leading end, and said guide face formed in said locking hook of said second connector housing also has an arc shaped leading end.

4. The waterproof connector as claimed in one of claims 1 and 3, wherein said covering body has a recess end face formed with a resilient member receiving recess, said resilient member receiving recess mounted with said resilient member of a bent elastic metal sheet.

* * * * *